US009974389B2

(12) United States Patent
Sander et al.

(10) Patent No.: US 9,974,389 B2
(45) Date of Patent: May 22, 2018

(54) ADJUSTING MECHANISM FOR ADJUSTING A RESTORING FORCE ACTING ON THE BACKREST OF A CHAIR, AND OFFICE CHAIR PROVIDED WITH SUCH AN ADJUSTING MECHANISM

(71) Applicant: Hangzhou Zhongtai Industrial Group Co., Ltd, Hangzhou, Zhejiang (CN)

(72) Inventors: Armin Roland Sander, Fuerth (DE); Peter Horn, Fuerth (DE)

(73) Assignee: Hangzhou Zhongtai Industrial Group Co., Ltd., Hangzhou (CN)

( * ) Notice: Subject to any disclaimer, the term of this patent is extended or adjusted under 35 U.S.C. 154(b) by 182 days.

(21) Appl. No.: 14/972,148

(22) Filed: Dec. 17, 2015

(65) Prior Publication Data

US 2016/0174720 A1 Jun. 23, 2016

(30) Foreign Application Priority Data

Dec. 19, 2014 (DE) ..... 10 2014 226 645

(51) Int. Cl.
*A47C 1/03* (2006.01)
*A47C 3/02* (2006.01)
(Continued)

(52) U.S. Cl.
CPC ..... *A47C 7/441* (2013.01); *A47C 1/03255* (2013.01); *A47C 1/03266* (2013.01);
(Continued)

(58) Field of Classification Search
CPC ..... A47C 1/03255; A47C 1/03266; A47C 1/03272; A47C 3/026; A47C 3/30; A47C 7/34; A47C 7/441; A47C 7/443
See application file for complete search history.

(56) References Cited

U.S. PATENT DOCUMENTS 5,207,479 A * 5/1993 Wickman ..... A47C 3/026 297/302.4
2006/0255636 A1* 11/2006 Donati ..... A47C 1/025 297/301.1

(Continued)

FOREIGN PATENT DOCUMENTS

EP 1258211 A2 11/2002
EP 1258212 A2 11/2002

(Continued)

*Primary Examiner* — Ryan D Kwiecinski

(57) ABSTRACT

The adjusting mechanism serves for the setting of a restoring force acting on the backrest of a chair. A back support and a seat support are fastened on a support. A setting mechanism configured in the manner of scissors is provided for the weight setting. Said setting mechanism has two scissor arms which are connected to one another via a scissor pin. One of said scissor arms is formed by a spring element and is fastened with its front-side spring end on said support. The back spring end is fastened on said scissor pin. Said first scissor arm is connected to said back support in the manner of a connecting rod. An active lever length is defined between said scissor pin and a support pin about which said back support is mounted pivotably. A compact construction mode is achieved by the configuration of said scissor arm as a spring element.

12 Claims, 6 Drawing Sheets

(51) Int. Cl.

| | |
|---|---|
| ***A47C 7/34*** | (2006.01) |
| ***A47C 7/44*** | (2006.01) |
| ***A47C 3/026*** | (2006.01) |
| ***A47C 1/032*** | (2006.01) |

(52) U.S. Cl.
CPC ..... *A47C 1/03272* (2013.01); *A47C 3/026* (2013.01); *A47C 7/34* (2013.01); *A47C 7/443* (2013.01)

(56) References Cited

U.S. PATENT DOCUMENTS

2008/0054700 A1* 3/2008 Meidan ..... A47C 1/03238 297/361.1
2009/0302655 A1* 12/2009 Gorgi ..... A47C 1/03255 297/303.1
2013/0038105 A1* 2/2013 Sander ..... A47C 1/03255 297/303.1
2013/0221718 A1* 8/2013 Kelm ..... A47C 1/03272 297/337
2014/0306503 A1* 10/2014 Ni ..... A47C 1/03272 297/285
2015/0282620 A1* 10/2015 Bock ..... A47C 1/03211 297/342
2016/0192782 A1* 7/2016 He ..... A47C 1/03272 297/285
2017/0079435 A1* 3/2017 Donati ..... A47C 1/032
2017/0367485 A1* 12/2017 Salvoni ..... A47C 1/03272

FOREIGN PATENT DOCUMENTS

WO 2006114250 A1 11/2006
WO WO-2010103554 A1 * 9/2010 ..... A47C 1/03255
WO 2011141107 A1 11/2011

* cited by examiner

ADJUSTING MECHANISM FOR ADJUSTING A RESTORING FORCE ACTING ON THE BACKREST OF A CHAIR, AND OFFICE CHAIR PROVIDED WITH SUCH AN ADJUSTING MECHANISM

CROSS-REFERENCE TO RELATED APPLICATIONS

This present application claims the benefit of German Patent Application No. 10 2014 226 645.9 filed on Dec. 19, 2014, the contents of which are hereby incorporated by reference.

FIELD OF THE TECHNOLOGY

The invention concerns an adjusting mechanism for adjusting a restoring force acting on the backrest of a chair, which adjusting mechanism is provided with the features of the preamble of claim 1. The invention also relates to an office chair provided with such an adjusting mechanism.

BACKGROUND

Preferably, the office chair is equipped with a so-called synchronizing mechanism. The inclination of the backrest of such chairs can usually be adjusted counter a restoring force. In the case of comfort chairs it is provided that the restoring force can be set, in order to adapt it to the needs of users of different weights.

In this connection different mechanisms and methods are possible for setting purposes. For example, the prestress of a spring which exerts the restoring force can be set manually through an actuating element, such as a handwheel. However, to be able to adjust the spring prestress, a very high force is required, so that an expensive transmission is generally required, which also has the consequence that a relatively high number of revolutions are to be carried out to achieve a perceptible adjustment.

As an alternative, it can be provided to configure a whole spring assembly arrangement or, in general, the arrangement of the spring element to be pivotable, so that the articulation points of the spring element in the force parallelogram are changed.

Moreover, known setting possibilities often have the problem that the ratio of the initial force exerted by the spring element (in the rest position) to the maximum force (in the inclined position) often behaves unfavorably in the case of a performed weight setting. In other words, this means that the restoring force exerted by the spring element via the inclination adjustment of the chair backrest is perceived differently by a light person and a heavy person, for example in such a way that, in the case of a light person an initially perceived soft setting which is first of all perceived as pleasant is perceived more and more sluggish as the inclination increases, and vice versa in the case of a heavy person. Therefore, there is the problem of the correct setting beyond the inclination adjustment of the backrest.

Moreover, adjusting mechanisms are known from the prior art which, in order to set the restoring force, provide a change in an active lever length between a rotational axis of the backrest support and an action point of the spring element. Thus, for example, in the mechanism which is known from the international patent disclosure WO 2006/114250, a roller is adjusted with the aid of a setting lever, which roller is first guided along a surface on the backrest support and second along a surface of a pivoting lever, the roller and the pivoting lever moderating between the action point of the spring element and the backrest support in order to set different active lever lengths.

An adjusting mechanism can be gathered from published European patent application EP 1 258 212 A2, in which adjusting mechanism the action point of a spring element on the backrest support can be adjusted in order to change an active lever length between the action point and the pivot pin. In a similar way, EP 1 258 211 A2 describes a bearing block which can be displaced along a sliding guide in order to set different active lever lengths.

An adjusting mechanism similar to the present invention can be gathered from the international patent application WO 2011/141107 A1. The adjusting mechanism described therein comprises a setting mechanism which is configured in the manner of a pair of scissors for weight setting, thus for setting the restoring force in a weight-dependent manner. The pair of scissors comprises two scissor arms which are rotatably connected about a scissor pin. The first scissor arm is fixed by means of its second end to a backrest support and the second scissor arm is articulated with its second end to an articulation element in the form of a plate.

A spring element acts on this articulation element in order to exert the restoring force. The weight setting occurs by pivoting the scissors so that a spacing between the scissor pin and a support pin about which the backrest support is pivotable, is varied. Hereby the active lever length is varied in order to set the weight. By the special mechanism provided with the scissors and the articulation element, it is ensured that the spring element is arranged fixedly within a support.

SUMMARY

It is accordingly an object of the invention to provide a compact adjusting mechanism for adjusting the restoring force in the case of a chair of this type, in particular a chair having a synchronizing mechanism.

According to the invention, the object is achieved by an adjusting mechanism as described below and by an office chair having an adjusting mechanism of this type. The adjusting mechanism is generally configured for setting a restoring force which acts on the backrest of a chair. To this end, the adjusting mechanism has a spring element for generating the restoring force and a support and a back support which is mounted pivotably on the latter.

The adjusting mechanism starts here from the adjusting mechanism described in the international application WO 2011/141107 A1 and has a setting mechanism which is configured in the manner of scissors with a first scissor arm and a second scissor arm, both scissor arms being connected to one another such that they can be rotated about a common scissor pin. The first scissor arm is fastened on the back support and is mounted there pivotably. The first scissor arm is configured here particularly as a mechanically rigid component which is suitable for transmitting tension or compression forces. In particular, the first scissor arm is configured as a rigid, for example plate-like metal or plastic component. Furthermore, an active lever length is defined between a support pin on which the back support is pivotably mounted on the support, and the scissor pin, which active lever length can be changed with the aid of a setting mechanism for setting the restoring force.

To this end, the scissors and herewith the scissor pin are pivoted, actually about the setting pin and/or about an articulation pin. The backrest support is rotatably fastened to the support via the setting pin, and the second scissor arm is articulated rotatably to the support via the articulation pin.

Here, the second scissor arm is formed directly by the spring element, which exerts the restoring force. Furthermore, the spring element is fastened with its one end to the scissor pin and with that to the first scissor arm. The spring element is mounted with its second end on the support, and, according to a preferred embodiment, via an articulation pin rotatably on the support. The whole spring element is pivoted about the articulation pin upon the weight setting.

In contrast to the international application WO 2011/141107 A1, a direct connection and mechanical coupling take thus place between the spring element and the scissor pin. In the case of the spring element, it is dealt, in particular, with a tension or compression spring. This also means that he second scissor arm is not inherently rigid, but flexible in length because of the spring elongation. Overall, the spring element also experiences upon the weight setting, on which the scissor pin is pivoted, a rotation about its front-side articulation pin. By the direct integration of the spring element as second scissor arm, other mechanical deflection elements can be renounced in comparison with the international application WO 2011/141107 A1.

Investigations and tests have shown that, overall, the adjusting mechanism can be configured as a more compact construction by this renunciation, despite the fact that the spring element requires a certain construction space for the pivoting motion.

Overall, a adjusting mechanism of compact construction is thus achieved with this embodiment, which adjusting mechanism makes a particularly force-free weight setting possible as a result of the embodiment of the scissors. At the same time, a restoring force as constant as possible is ensured over the inclination adjusting travel of the backrest since no change of the spring travel takes place upon an inclination adjustment.

In view of an embodiment which is as compact as possible and at the same time stable, the scissor pin engages furthermore a first oblong hole inside the back support and/or penetrates the latter.

According to an appropriate development, the adjusting mechanism is configured in a such way that, in the unloaded basic position, the articulation pin and the setting pin are aligned at least to a great extent and preferably exactly in parallel to one another, and are thus positioned coaxially. The basic position is defined by a position of the back support in which a backrest fastened to the latter is in an upright starting position. The spring element and the first scissor arm run therefore in parallel to one another in the basic position. By this orientation in the basic position, a widest force-free rotation of the scissors about the setting pin or the articulation pin is given. Only friction forces act, no elastic force exerted by the spring element, however, counteracts the rotation of the scissors about the setting pin since no change of length of the spring takes place. In this way, a very simple, unloaded setting of the active lever length is possible for the user.

In the case of the adjusting device, it is, in particular, dealt with a manual adjusting device which can be operated with the aid of an actuating element. In particular, the adjusting device has as actuating element a rotatable hand- or setting wheel which is put outside the support, for example at the side, on a side cheek. Via the adjusting device, an adjusting force is exerted on the scissors such that they are adjusted for the weight setting. This one takes place either directly with the help of the adjusting device such that the adjusting device acts directly on the scissor pin and/or on the spring element. However, a setting arm is preferably arranged between the adjusting device and the spring element or the scissor pin, via which setting arm a indirect adjustment takes therefore place.

Here, the setting arm is mounted appropriately rotatably about a front-side rotating pin and acts with a rear arm region on the scissors. In particular, the setting arm has a second oblong hole in which the scissor pin is positioned. This is why a pivoting motion of the setting arm about its front-side rotating pin is caused via the adjusting device, which causes again a rotation of the scissors for the weight setting. In the case of the front-side rotating pin, it is dealt, in particular, with the articulation pin, about which the spring element is also rotatably mounted on the support.

In an appropriate development, the adjusting device has here a setting wheel which is rotatable about an adjusting pin, via which setting wheel the scissor pin is adjusted upon a rotation of the setting wheel. On this occasion, the setting wheel rolls on another mechanical transmission element, by which the rotation of the setting wheel is transmitted into an adjusting motion of the scissor pin. The setting wheel is arranged inside the support, and is in a mechanically rigid, active connection to the handweel, which can be operated from outside the support. In particular, the adjusting pin is formed by a shaft on which the external adjusting button is also arranged at the same time.

In a particularly appropriate embodiment, the setting wheel is configured eccentrically. The setting wheel rolls here with its peripheral surface on the transmission element, particularly on the setting arm. By the eccentric embodiment, a distance between the adjusting pin and the transmission element is varied here such that, through this, a mechanical conversion of a rotation into an adjusting movement finally takes place.

In a preferred embodiment, a locking device is generally provided for fixing the set active lever length such that this is unchangeable even in the case of an adjustment of the inclination. Here, the locking device is appropriately active automatically after a setting has taken place, without it requiring an additional operation by the user. The adjusting device and the locking device are at least coupled to one another. In particular, the adjusting device already configures itself the locking device. In this manner, a self-locking spindle is arranged for example as a locking device.

The active lever length is set via the spindle by way of a rotational adjustment. The spindle acts for example with its one end on the scissor pin and is supported with the other end on the back support, preferably on the support pin.

In a preferred embodiment, the above described setting wheel has, however, several indentations which are arranged successively to one another in the peripheral direction, a respective indentation defining a respective setting position each time. Upon a rotation of the particularly eccentric setting wheel, a virtually perceptible and tangible stepwise adjustment of the weight setting takes place.

The indentations cooperate, here, with a thrust bearing which is configured in particular as a fixation bolt. This fixation bolt engages therefore a respective indentation. Through this, a certain fixation by latching is achieved, by which an undesired adjustment of the weight setting is counteracted, and the set lever length is therefore locked.

The fixation bolt is here appropriately fastened on the setting arm. The setting wheel rolls therefore on the fixation bolt, which is fastened on the setting wheel. The fixation bolt is thus a part of the setting arm.

A complementary embodiment is fundamentally also possible in which, therefore, the fixation bolt is configured on the setting wheel and the different indentations are configured on the setting arm.

In view of a reliable self-locking fixation, the fixation bolt is arranged appropriately with respect to the indentations such that the forces introduced in the adjusting mechanism act in such a way that the fixation bolt is pressed into the indentation such that the fixation bolt does not come out of the indentations undesirably.

To this end, it is provided, in particular, that the fixation bolt is positioned at least substantially on a vertical line which cuts the adjusting pin of the setting wheel. Preferably, the fixation bolt is positioned, here, on a vertical line, i.e. exactly perpendicularly under the adjusting pin of the setting wheel. By at least substantially, a deviation of maximum 5° or maximum 10° from the exact vertical line is here understood.

It is generally ensured in particular by this self-locking mechanism that the lever length which has been set once and, with that, the restoring force which has been set once are constant over the entire adjusting travel of inclination upon an inclination adjustment of the back. The lever length is therefore only adjusted with the aid of the adjusting device, otherwise it is fixed. Through this, it is prevented that the restoring force varies with the increasing inclination of the backrest.

As an alternative to this eccentric setting wheel, the rotation of the setting wheel is converted into a linear movement of an oblique slide way, such a slide way being mechanically connected to the scissor pin for the adjustment of the latter. The rotation of the setting wheel is converted on this occasion in particular with the aid of a sliding element into a linear movement. Here, the sliding element is mounted appropriately, in particular, slidably on the support. This sliding element has a oblique slide way here such that a sliding movement of the sliding element for example in a horizontal direction leads to a vertical movement which is transmitted to the scissor pin for the adjustment. of the latter. Appropriately, a guiding bolt engages the sliding way to this end. In the case of this guiding bolt, it is dealt in particular with a bolt mounted on the setting arm, and is comparable to the fixation bolt in this respect. The transmission of the rotation of the setting wheel to the sliding element takes place here for example with the aid of a toothed wheel work between the setting wheel and the sliding element.

In view of a compact embodiment, the pivoting pin is preferably arranged below the supporting pin, and the scissors are arranged between these both articulation points. Below and above refer here to the usual positions of a chair: i.e. by above, the orientation towards the seat is to be understood, and by below the orientation towards the floor is to be understood.

The support is generally preferably configured in the manner of a shell with side walls which lie opposite one another, all elements of the adjusting mechanism being preferably received in the shell interior. The individual above-described elements of the adjusting mechanism, such as scissors and spring element, are preferably present in double configuration and are arranged opposite one another in the region of the side walls of the support. The individual pins are each time defined by shafts or bolts. The spring element is configured, in particular, as a compression spring.

BRIEF DESCRIPTION OF THE DRAWINGS

An exemplary embodiment of the invention is explained more in detail in the drawings. These are partly diagrammatic representations.

DETAILED DESCRIPTION

Figure 1A:
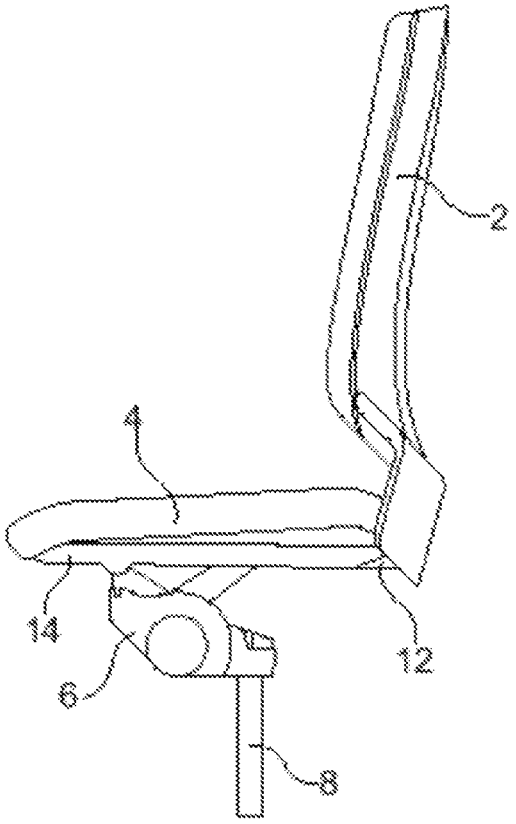
FIG. 1A is a side view of an office chair with a synchronizing mechanism with upright backrest.
Figure 1B:
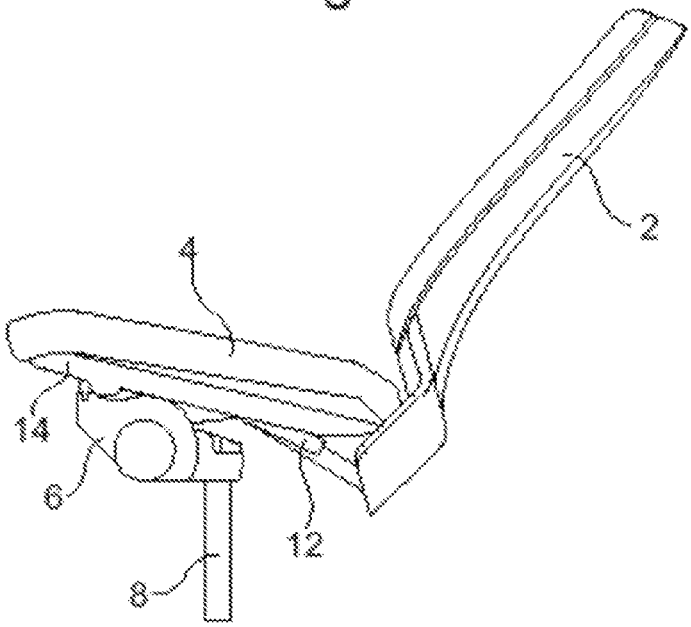
FIG. 1B is the office chair according to FIG. 1A in a loaded state with an inclined backrest.

An office swivel chair with a synchronizing mechanism shown on FIGS. 1A and 1B comprises a back 2, a seat 4, a seat or adjusting mechanism 6 which is arranged below the seat 4 and in which the individual components for setting a restoring force which acts on the back 2 are integrated. Furthermore, a standing tube 8 can be seen which is connected to a non-illustrated foot part. The standing tube is usually configured as a telescopic tube, via which a height setting can be performed. A movement of the seat 4 and that of the back 2 are coupled to one another by way of the synchronizing mechanism. To be precise, in the case of an adjustment of the back 2 from the position shown in FIG. 1A into the position shown in FIG. 1B, the seat is transferred from a substantially horizontal orientation according to FIG. 1A into an obliquely rearwardly inclined position.

The synchronizing mechanism contains a back support 12, via which the back 2 is fastened. Furthermore, the synchronizing mechanism contains a seat support 14 which carries the seat 4.

As can be gathered from FIGS. 2 to 4, the adjusting mechanism 6 contains a housing which is of a shell-like configuration in the exemplary embodiment and is called a support 16 in the following text. The seat support 14 and the back support 12 are fastened to the support 16. Here, the back support 12 is articulated such that it can be pivoted about a support pin A1 which is defined by a support shaft. Preferably, the back support is exclusively mounted on the support 16 the via the support pin. The support 16 has two side cheeks 18 which enclose a central space between them.

The adjusting mechanism 6 contains a setting mechanism 20 which is configured in the manner of scissors with a first scissor arm 20A and a second scissor arm 20B which is formed by a spring element 24. The first scissor arm 20A is mounted on the back support 12 such that the first scissor arm 20A can be pivoted via a setting shaft which defines a setting pin A2. Both scissor arms 20A, 20B are connected to each other via a scissor bolt which defines a scissor pin A3. The spring element 24 is mounted with its front-side end directly on support 16 via an articulation bolt which defines an articulation pin A4.

An active lever length W1 is defined between the support pin A1 and the scissor pin A3. (see FIGS. 3A and 4A).

In the exemplary embodiment, the seat support 14 and the back support 12 are pivotably connected to each other on an action pin A6. Here, the action pin A6 is arranged in a rear region of the adjusting mechanism 6, particularly behind the setting pin A2. Furthermore, the seat support 14 is fastened pivotably movably to the support 16 via a supporting pin A7 in a front-side region.

Figure 2A:
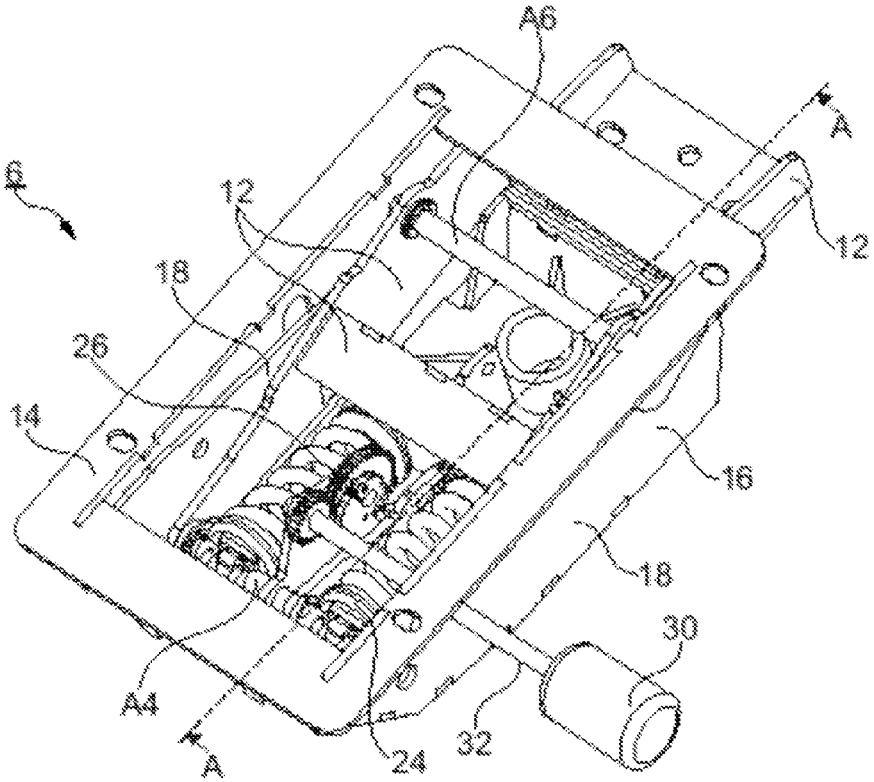
FIG. 2A is a perspective view of an adjusting mechanism with a back support and a seat support in a basic position (upright backrest)

The support 16 is—as it can be seen particularly from FIG. 2A—of a shell-like configuration and accommodates the individual components of the adjusting mechanism 6 in its free internal space. Here, the seat support 14 is configured like a frame part which has a L-shape cross-section, the one horizontal L-arm having fastening holes in order to fasten the seat 4.

The respective vertical L-arm which is directed downwards serves on the other hand for fastening the seat support 14 on the support 16 (preferably exclusively via supporting pin A7) and for fastening on the back support 12 (preferably exclusively via action pin A6).

The seat support 14 surrounds the support 16 with its vertical L-shaped legs in the way of a frame.

The back support 12 has two opposite flat side components or side cheeks which are connected to each other in particular via a median and a rear transverse web.

Furthermore, it can be seen particularly from FIG. 2A that the action pin A6 connects both side cheeks of the back support 12.

The shaft which forms the scissor pin A3, at least the shaft ends, extends in each possible position in a respective first oblong hole 22 inside a respective side cheek of the back support 12. In particular, the respective shaft ends are accommodated in the first oblong hole 22, which ends are secured for slipping in the direction of the shaft by means of a securing element which in particular engages the first oblong hole 22 here.

Figure 2B:
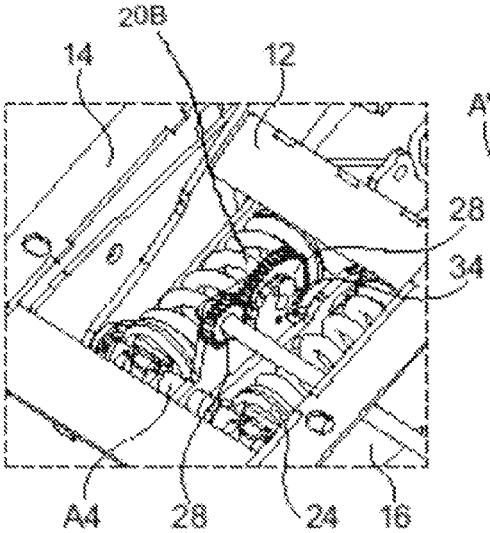
FIG. 2B is an enlarged detail of the view according to FIG. 2A.
Figure 2C:
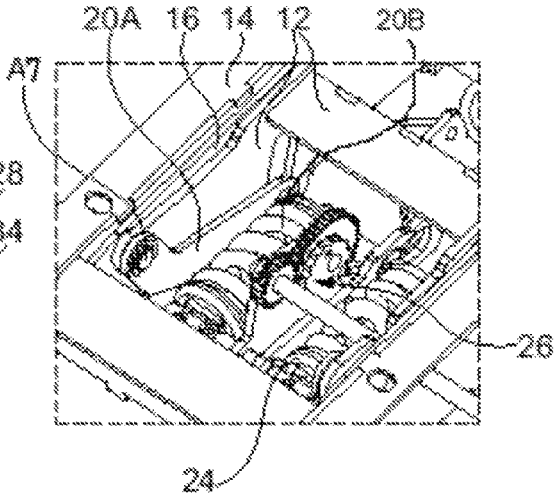
FIG. 2C is, similar to FIG. 2B, an enlarged detail of the view of an adjusting mechanism with a back support and a seat support in an inclined position (inclined backrest)

As can be gathered furthermore from FIGS. 2A to 2C, altogether two spring elements 24 are arranged in the exemplary embodiment which are arranged in parallel next to each other and are configured in particular as compression springs. The spring elements 24 are connected to each other at their front-side end via the articulation pin A4, and at their rear spring end via the articulation pin A3.

The first scissor arm 20A is configured in particular as a flat mechanically rigid component, in particular as a sheet metal component of the kind of a tension or compression connecting rod. The tension connecting rod is configured here in particular as being cranked, i.e. it has two partial regions which are in an (obtuse-) angle arrangement to one another. This is particularly advantageous for a place-saving construction mode.

In the exemplary embodiment, a tension connecting rod is arranged each time at both sides of the spring elements 24. Each of the tension connecting rods is connected here to a respective side cheek of the back support 12 via a respective bolt which defines the setting pin A2.

An adjusting device 26 is arranged to adjust the active lever length W. This device is preferably arranged in the exemplary embodiment between both spring elements 24.

The adjusting device 26 has in the exemplary embodiment several toothed wheels 28 to configure a transmission. Two toothed wheels 28 are provided in the exemplary embodiment. The desired weight setting can be performed by rotating a handwheel 30 which is arranged outside the support 16 and which is connected via a shaft 32 to one of the toothed wheels 28.

The exerted rotation is transmitted via the toothed wheels 28 to an eccentric setting wheel 34. This latter is rotatable about a adjusting pin A8. The adjusting pin A8 is formed again by a bolt or a shaft and is arranged coaxially with respect to the rotation axis of the second toothed wheel 28. The second toothed wheel 28 and the setting wheel 34 are therefore arranged on a common shaft.

By an eccentric design of the setting wheel 34, it is understood that a peripheral line is not arranged concentrically with the adjusting pin A8. The radial distance of the peripheral line of the setting wheel 34 varies rather. On this peripheral line of the setting wheel 34, several successive indentations 36 are configured which have for example in each possible position an angular distance of a few degrees with respect to one another. In the exemplary embodiment, the setting wheel 34 is configured as a worm wheel.

Furthermore, the adjusting device 26 contains a setting arm 38 (FIGS. 3C, 3D and FIGS. 4C, 4D), which is also mounted pivotably movably on the support 16. Particularly, the setting arm 38 is mounted here on the shaft which forms the articulation pin A4, together with the spring elements 24.

At its back end, the setting arm 38 has a second oblong hole 40, through which the shaft of the scissor pin A3 is guided. The setting wheel 34 is connected mechanically in a median region of the setting arm 38 to the latter. To this end, the setting arm 38 has a fixation bolt 42 which protrudes from the setting arm 38 in the traverse direction. The setting wheel 34 rolls with the indentations 36 on this fixation bolt 42. Preferably, the setting arm is configured again as a mechanically rigid component which has the shape of a plate or a strip, in particular as a sheet metal component.

Figure 3A:
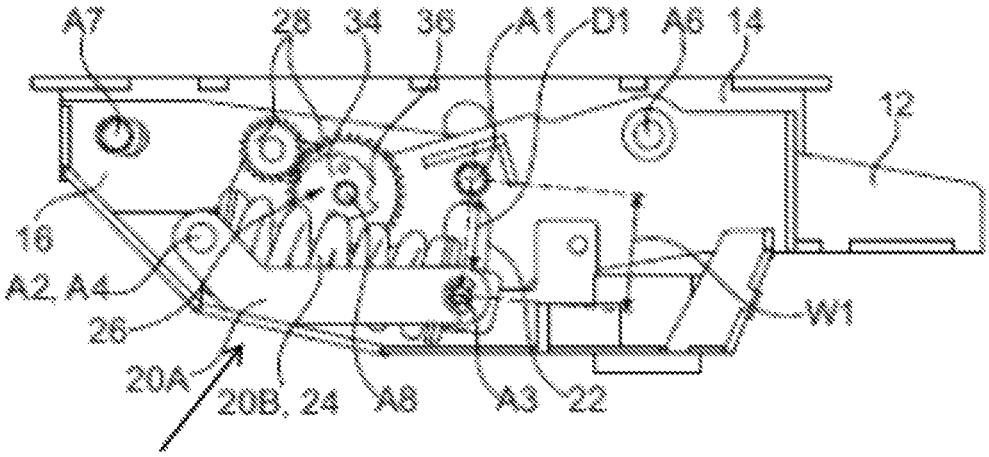
FIG. 3A is a sectional side view of the adjusting mechanism according to cutting line A-A in FIG. 2A without support sides in the "heavy" weight setting, in the basic position.
Figure 3B:
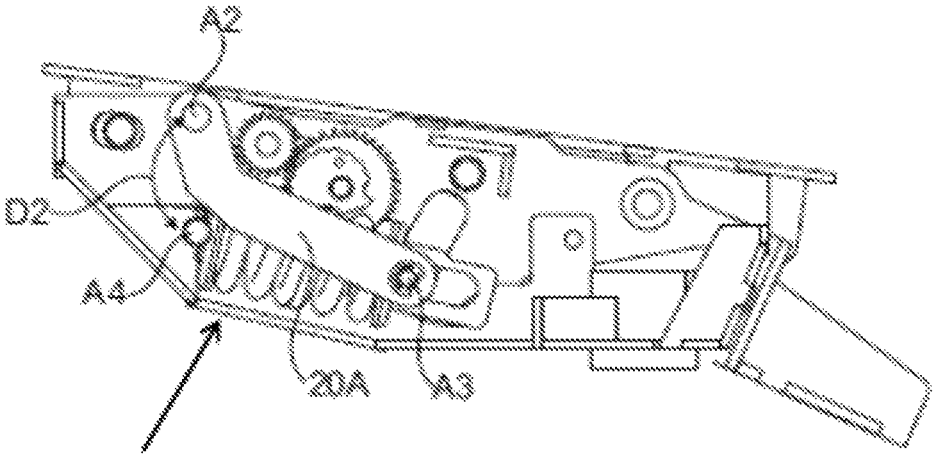
FIG. 3B is a side view similar to FIG. 3A in the "heavy" weight setting, in the inclined position.
Figure 3C:
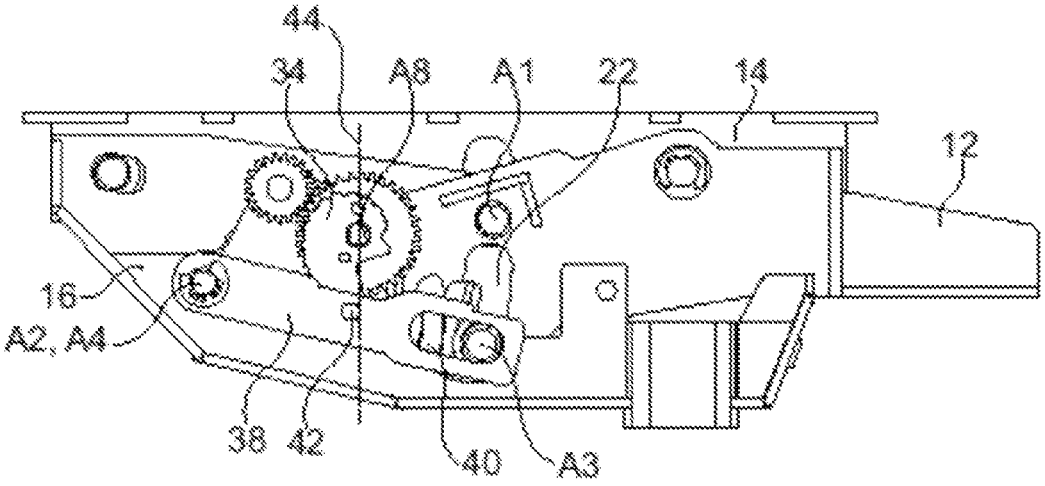
FIG. 3C is a sectional side view of the adjusting mechanism according to cutting line A-A in FIG. 2A, the adjusting mechanism being in the "heavy" weight setting, in the basic position.
Figure 3D:
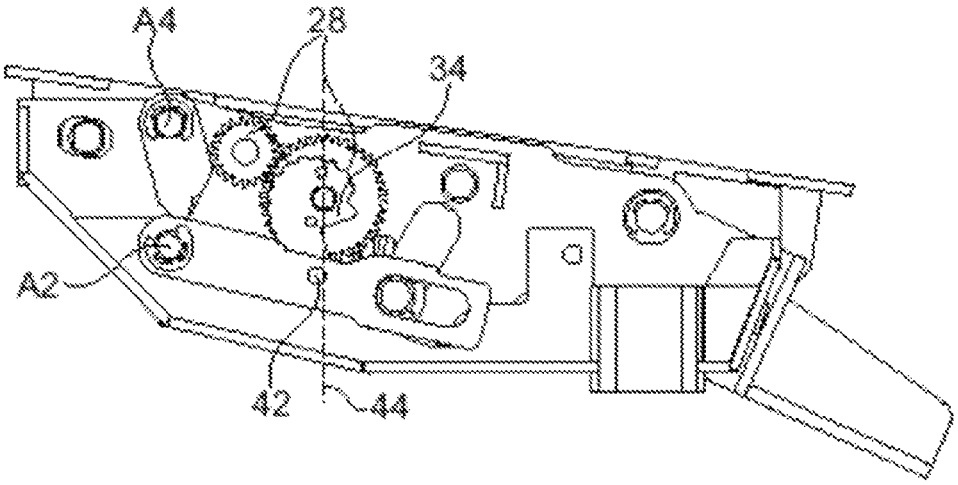
FIG. 3D is, similar to FIG. 3C, a sectional side view of the adjusting mechanism according to cutting line A-A in FIG. 2A, the adjusting mechanism being in the "heavy" weight setting, in the inclined position.

As can be gathered for example from FIGS. 3C,3D, the fixation bolt 42 and the adjusting pin A8 are on a common vertical line 44.

The fixation bolt 42 is forced elastically towards the setting wheel 34 into a respective indentation 36. This pressure exerted by an elastic force is achieved automatically in the exemplary embodiment by the special orientation and mounting position of the respective spring element 24, which results in a resulting force component in the vertical direction. As an alternative or complement, a separate spring element is arranged which forces the fixation bolt 42 into the indentations 36.

Figure 4A:
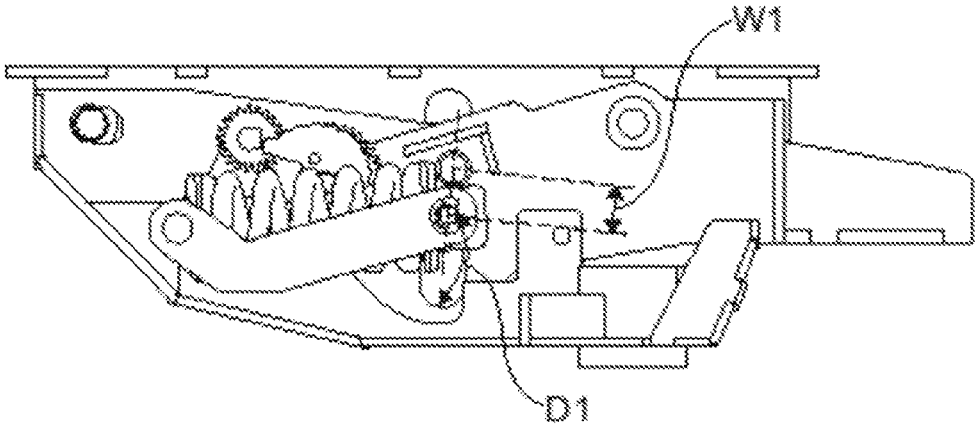
FIGS. 4A to 4D are the representations corresponding to the FIGS. 3A to 3D in the "light" weight setting.
Figure 4B:
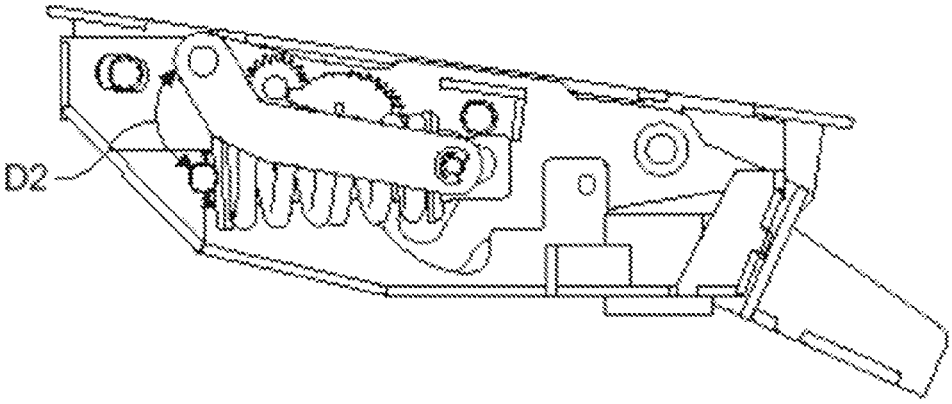
Figure 4C:
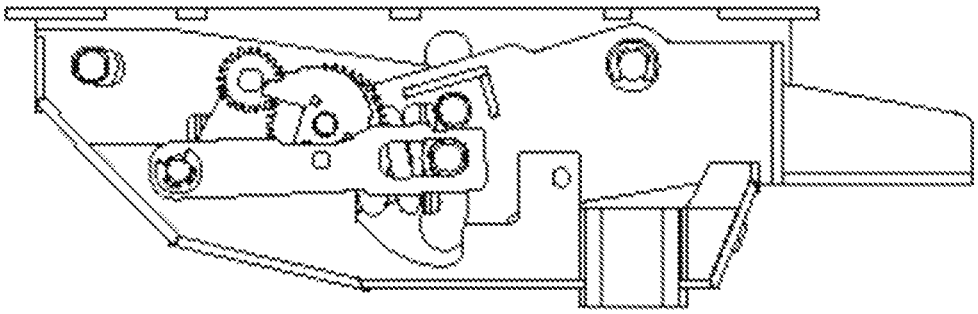
Figure 4D:
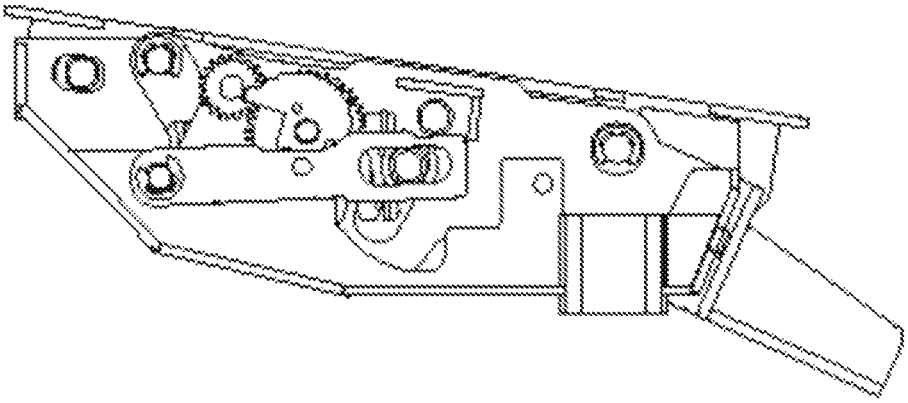

The method of operation of the adjusting mechanism 6 for the weight setting is as follows:

In the basic position (FIGS. 3A, 4A), the active lever length W1 is changed to a great extent force-free with the help of the adjusting device 26, for example from the weight setting "heavy", which is shown on FIG. 3A, into the weight setting "light", which is shown on FIG. 4A. The weight setting takes place by a rotation on the handweel 30 which is transmitted such that the setting wheel 34 rotates. In this way, the setting wheel 34 rolls on the fixation bolt 42 such that the radial distance between the setting arm 38 and the adjusting pin A8 varies. This leads to a pivoting of the setting arm 38 about the articulation pin A8. Simultaneously, a restricted guidance of the scissor pin A3 takes place via the second oblong hole 40 in the direction of the double arrow D1, which is drawn on FIG. 3A.

As the articulation pin A4 and the setting pin A4 are aligned with one another or coincide in the basic position, no length change of the spring element 24 is involved by this adjusting motion and thus by the rotation of the spring element 24 about the articulation pin A4. The adjustment is therefore force-free—except possible friction forces—and can thus be carried out very easily.

The active lever length W1, which has been set once, remains constant even in the case of an inclination of the back support 12. In the case of such an inclination, the back support 12 rotates about the support pin A1 such that its front-side end and herewith the setting pin A2 is pulled upwards (in this regard, see the FIGS. 3B, 4B). This is why the setting pin A2 pivots in the direction of the double arrow D2, which is represented in FIG. 3. The active lever length W1 is thus generally changed via the adjusting device 26 by the fact that the scissor pin A3 is pivoted about the articulation pin A4.

The particular advantage in the case of this embodiment can be seen in the fact that the adjustment takes place nearly weightless, since no elastic forces are exerted in the basic position. The position of the scissor pin A3 is fixed in the desired position because of a self-locking of the adjusting device 26, and is maintained even in the case of an inclination adjustment.

The special embodiment of the adjusting device 26, which is described herein, is fundamentally also transformable irrespective of the special combination of features recited in the claims. In particular, an adjusting device 26 of this kind having particularly the eccentrically mounted setting wheel 24 can be used in the case of other adjusting mechanisms, in particular in the case of the adjusting mechanism described in the international WO 2011/141107 A1. In this respect, the embodiment of this adjusting device 26 is considered to be an independent inventive aspect, and the filing of a divisional application remains reserved.

Overall, the described embodiment achieves a compact mechanism for weight setting which is distinguished, in particular, by a virtually force-free weight setting in the basic position. Furthermore, a comparable profile of the restoring force is achieved over the adjusting travel in the case of an adjustment of the inclination, independently of the performed weight setting. In particular, the ratios of the restoring forces in the upright and the inclined end positions are at least similar to one another in a "light" weight setting and in a "heavy" weight setting, and the profile of the restoring force over the inclination travel is also at least largely independent of the performed weight setting.

| List of designations | |
|---|---|
| 2 | Back |
| 4 | Seat |
| 6 | Adjusting mechanism |
| 8 | Standing tube |
| 12 | Back support |
| 14 | Seat support |
| 16 | Support |
| 18 | Side cheek |
| 20 | Setting mechanism |
| 20A | First scissor arm |
| 20B | Second scissor arm |
| 22 | First oblong hole |
| 24 | Spring element |
| 26 | Adjusting device |
| 28 | Toothed wheel |
| 30 | Handwheel |
| 32 | Shaft |
| 34 | Setting wheel |
| 36 | Indentation |
| 38 | Setting arm |
| 40 | Second oblong hole |
| 42 | Fixation bolt |
| 44 | Vertical line |

-continued

| List of designations | |
|---|---|
| A1 | Support pin |
| A2 | Setting pin |
| A3 | Scissor pin |
| A4 | Articulation pin |
| A5 | Pivot pin |
| A6 | Action pin |
| A7 | Supporting pin |
| A8 | Adjusting pin |
| D1 | First double arrow |
| D2 | Second double arrow |
| W | Active lever length |

The invention claimed is:

1. An adjusting mechanism for setting a restoring force acting on a backrest of a chair, the adjusting mechanism comprising:

a spring element for generating the restoring force;

a support and a back support mounted on said support such that said back support is configured to pivot about a support pin; wherein said mechanism comprises:

a setting mechanism borne with a setting pin, said setting mechanism being configured in the manner of scissors for a weight-dependent setting of the restoring force, said setting mechanism comprising a scissor pin and further comprising a first scissor arm and a second scissor arm and wherein the first and second scissor arms being connected to one another and configured to rotate about the scissor pin, said first scissor arm being mounted on said backrest support by the setting pin such that said first scissor arm is configured to pivot about the setting pin; and a lever length being defined between said support pin and said scissor pin, said lever length being changeable with the aid of an adjusting device for setting the restoring force by pivoting said setting mechanism, wherein said second scissor arm is formed by said spring element, and said spring element is mounted on said support at a first end by said scissor pin and thereby connected to the first scissor arm, and the spring element is mounted on an articulation pin at a second end.

2. The adjusting mechanism according to claim 1, wherein said spring element is able to be pivoted about said articulation pin for setting said lever length.

3. The adjusting mechanism according to claim 1, wherein said scissor pin engages a first oblong hole inside said back support.

4. The adjusting mechanism according to claim 1, wherein said adjusting device is able to be operated manually, and acts via a setting arm on said scissor pin for the setting of said scissor pin.

5. The adjusting mechanism according to claim 4, wherein said setting arm is mounted such that it is able to be rotated about the articulation pin, and is connected furthermore mechanically to said scissor pin via a second oblong hole in which said scissor pin is positioned.

6. The adjusting mechanism according to claim 1, wherein said adjusting device has a setting wheel which is rotatable about an adjusting pin inside said support, via which said scissor pin is adjusted upon a rotation of said setting wheel.

7. The adjusting mechanism according to claim 6, wherein said setting wheel is configured eccentrically and said setting wheel rolls on said setting arm.

8. The adjusting mechanism according to claim 7, wherein said setting wheel has several indentations in the peripheral direction which in each position define a setting position, a fixation bolt being positioned, in a respective setting position, in a respective indentation.

9. The adjusting mechanism according to claim 8, wherein said fixation bolt is fastened on said setting arm.

10. The adjusting mechanism according to claim 8, wherein said fixation bolt is arranged with respect to said indentations such that a self-locking fixation is achieved in the chosen setting position.

11. The adjusting mechanism according to claim 8, wherein said fixation bolt is positioned substantially on a vertical line which intersects said adjusting pin.

12. The adjusting mechanism according to claim 1, wherein a rotation of setting wheel is converted into a linear movement of an oblique slide way, and said slide way is connected mechanically to said scissor pin for the adjustment of said scissor pin.

* * * * *